US010151489B2

(12) United States Patent
Rathmann et al.

(10) Patent No.: US 10,151,489 B2
(45) Date of Patent: Dec. 11, 2018

(54) COMBUSTOR ARRANGEMENT WITH FASTENING SYSTEM FOR COMBUSTOR PARTS

(71) Applicant: ANSALDO ENERGIA SWITZERLAND AG, Baden (CH)

(72) Inventors: Ulrich Rathmann, Baden (CH); Naresh Aluri, Ennetturgi (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 237 days.

(21) Appl. No.: 14/868,782

(22) Filed: Sep. 29, 2015

(65) Prior Publication Data

US 2016/0091208 A1 Mar. 31, 2016

(30) Foreign Application Priority Data

Sep. 30, 2014 (EP) ..... 14187112

(51) Int. Cl.
*F23R 3/60* (2006.01)
*F23R 3/00* (2006.01)
(Continued)

(52) U.S. Cl.
CPC ..... *F23R 3/60* (2013.01); *F23R 3/002* (2013.01); *F23R 3/007* (2013.01); *F23R 3/28* (2013.01);
(Continued)

(58) Field of Classification Search
CPC ..... F05D 2230/642; F05D 2240/14; F05D 2240/35; F05D 2260/30; F05D 2260/941;
(Continued)

(56) References Cited

U.S. PATENT DOCUMENTS 3,922,851 A * 12/1975 Irwin ..... F23R 3/007 60/39.821
3,990,231 A * 11/1976 Irwin ..... F23R 3/007 60/800
(Continued)

FOREIGN PATENT DOCUMENTS

EP 1 312 865 A1 5/2003

OTHER PUBLICATIONS

Office Action dated Jul. 27, 2018 in corresponding European Application No. 15 185 667.1.

*Primary Examiner* — Scott Walthour
(74) *Attorney, Agent, or Firm* — Buchanan Ingersoll & Rooney PC

(57) ABSTRACT

A combustor arrangement with a front panel, a combustor liner, and a carrier structure element is provided for carrying the front panel and the combustor liner, wherein the combustor arrangement further includes a fastening system for connecting the front panel, the combustor liner, and the carrier structure element to one another. The fastening system includes at least one elastic connection element, the latter being fixedly connected to the carrier structure element and extending therefrom to the combustor liner and to the front panel. The elastic connection element is further fixedly connected to the combustor liner and/or the front panel such as to clamp the front panel, the combustor liner, and the carrier structure element to one another in a substantially fluid tight manner.

19 Claims, 3 Drawing Sheets

(51) Int. Cl.

| | |
|---|---|
| ***F23R 3/54*** | (2006.01) |
| ***F23R 3/46*** | (2006.01) |
| ***F23R 3/42*** | (2006.01) |
| ***F23R 3/50*** | (2006.01) |
| ***F23R 3/58*** | (2006.01) |
| ***F23R 3/44*** | (2006.01) |
| ***F23R 3/52*** | (2006.01) |
| ***F23R 3/28*** | (2006.01) |

(52) U.S. Cl.
CPC ..... *F23R 3/283* (2013.01); *F23R 3/42* (2013.01); *F23R 3/425* (2013.01); *F23R 3/44* (2013.01); *F23R 3/46* (2013.01); *F23R 3/50* (2013.01); *F23R 3/52* (2013.01); *F23R 3/54* (2013.01); *F23R 3/58* (2013.01); *F05D 2230/642* (2013.01); *F05D 2240/14* (2013.01); *F05D 2240/35* (2013.01); *F05D 2260/30* (2013.01); *F05D 2260/941* (2013.01); *F05D 2300/50212* (2013.01); *F23R 2900/00005* (2013.01); *F23R 2900/00012* (2013.01); *F23R 2900/00017* (2013.01); *F23R 2900/03342* (2013.01)

(58) Field of Classification Search
CPC ..... F05D 2300/50212; F23R 3/002; F23R 3/007; F23R 3/28; F23R 3/283; F23R 3/42; F23R 3/425; F23R 3/44; F23R 3/46; F23R 3/50; F23R 3/52; F23R 3/54; F23R 3/58; F23R 3/60; F23R 2900/00005; F23R 2900/00012; F23R 2900/00017; F23R 2900/03342
See application file for complete search history.

(56) References Cited

U.S. PATENT DOCUMENTS

| | | | | |
|---|---|---|---|---|
| 5,353,587 | A * | 10/1994 | Halila | F23R 3/002 60/39.37 |
| 6,397,603 | B1 * | 6/2002 | Edmondson | F23R 3/007 60/746 |
| 7,082,766 | B1 | 8/2006 | Widener | |
| 2005/0050902 | A1 | 3/2005 | Anichini | |
| 2006/0242965 | A1 * | 11/2006 | Shi | F23R 3/007 60/796 |
| 2010/0011776 | A1 * | 1/2010 | Moraes | B23P 11/025 60/753 |
| 2015/0330635 | A1 * | 11/2015 | Pidcock | F23R 3/10 60/748 |

* cited by examiner

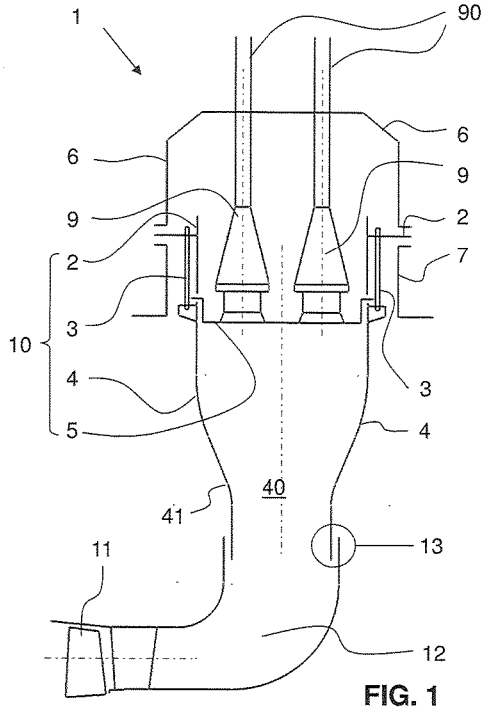
FIG. 1
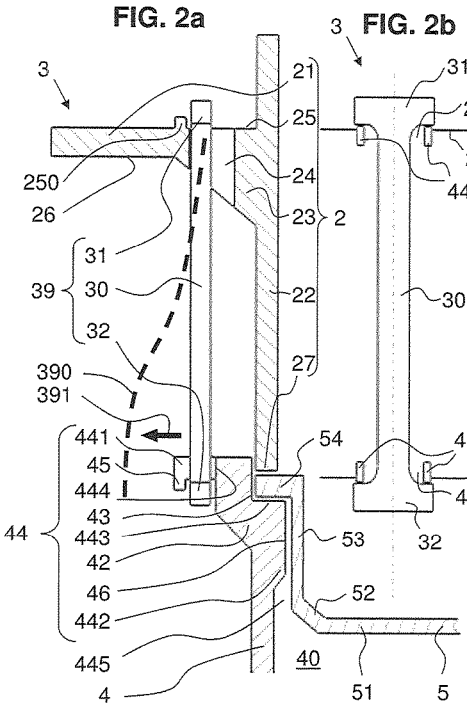
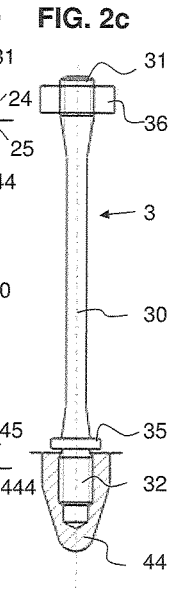

COMBUSTOR ARRANGEMENT WITH FASTENING SYSTEM FOR COMBUSTOR PARTS

CROSS-REFERENCE TO RELATED APPLICATIONS

This application claims priority to EP Application No. 14187112.9 filed Sep. 30, 2014, the contents of which is hereby incorporated in its entirety.

TECHNICAL FIELD

The present invention relates to the technology of gas turbines. It refers to a combustor arrangement with a fastening system for combustor parts, in particular for a silo, can, or annular combustor of the gas turbine.

BACKGROUND

In order to increase an efficiency of a gas turbine undesirable leakage of working fluids should be minimized. During operation of the gas turbine, temperature differences arise across elements of the gas turbine. Combustor hot gas parts are commonly connected to colder carrier structures with a plurality of sliding joints or gaps in between to compensate the different thermal expansion of parts. These joints are the source for leakages which are undesirable in any efficient combustion system. Common sealing systems typically only limit the leakages in the hot state due to the necessity to allow for thermal movements.

Another approach currently used is to provide a sequence of weldings for permanently joining the hot gas parts to one another and for connecting them to the colder carrier structures. This method has, however, the disadvantage that thermal expansion cannot be fully compensated, which eventually leads to cracks or other damages. Additionally, the combustor unit can only be exchanged as a complete assembly, since it is not possible to replace single parts without cutting and re-welding the joints.

SUMMARY OF THE INVENTION

Accordingly, it is an object of the present invention to provide a combustor arrangement, in particular for a silo, a can, or an annular combustor, preferably for a gas turbine, wherein the combustor arrangement minimizing a leakage rate through the contact region between the combustor parts in the hot and cold state.

This object is achieved by the combustor arrangement with the features according to claim 1. Accordingly, a combustor arrangement, in particular for a silo, a can, or an annular combustor, is suggested that comprises:

a front panel, wherein the front panel is configured to receive at least one combustor element;

a combustor liner arranged substantially downstream of the front panel, wherein the combustor liner partly delimits a combustion chamber;

a carrier structure element for carrying the front panel and the combustor liner, wherein the combustor arrangement further comprises a fastening system for connecting the front panel, the combustor liner, and the carrier structure element to one another, wherein the fastening system comprises at least one elastic connection element, said elastic connection element being fixedly connected to the carrier structure element and extending therefrom to the combustor liner and to the front panel, wherein said elastic connection element is further fixedly connected to the combustor liner and/or the front panel such as to clamp the front panel, the combustor liner, and the carrier structure element to one another in a substantially fluid tight manner.

The present invention is based on the insight that, in the cold state (e.g. at room temperature, e.g. after flame-off) the combustor parts may be clamped by an arrangement of at least one, preferably a plurality of circumferentially arranged elastic connection elements which ensures that the clamped combustor parts (i.e. the front panel, the combustor liner, and the carrier structure element) apply tensile stress onto the elastic connection element such that the connection element's elasticity keeps the combustor parts in a substantially leakage-tight arrangement. Due to this "self-tensioning" effect it is possible to easily assemble the combustor parts in cold condition, e.g. by hooks or with a thread that can be installed in a "finger tight" manner. Accordingly, the present invention relates to a combustor arrangement of hot gas—and carrier parts joined by a flexible clamping system that provides sufficient contact loads and allows for easy disassembly.

Moreover, the fasting system according to preferred embodiments of the invention may include a thermal matching feature. Accordingly, the fastening system elements may be designed (material and shape) such that upon heat exposure the thermal expansion of the clamping length (i.e. effective axial length of parts that experience tensile stress due to clamping) is, at least in axial direction (which is the main direction of the clamping force), the same as or smaller than the thermal expansion of the clamped length (i.e. effective axial length of the parts that experience compressive stress due to clamping). In addition or in the alternative, a compensation element with a high thermal expansion in axial direction may be used such that the clamping force is not lost upon heating the combustor parts during typical operation. Accordingly, it is an aspect of the present invention to have a flexible clamping system with a carrier part and a hot gas part, further including a pre-load system acting by thermal expansion matching.

The term "fastening system" refers to a clamping structure that engages at least two of the front panel, the combustor liner, and the carrier structure element directly, preferably with a form fit, and clamps the three combustor parts securely to one another.

The terms "upstream" and "downstream" refer to the relative location of components in a pathway of the working fluid. The term "axial" refers to the direction along the general flow direction of the working fluid; the terms "lateral" and "radial" refer to the direction perpendicular to the axial direction. The term "outward" refers to the radial direction away from a center of the respective element; "inward" refers to the opposite direction. The term "liner is arranged substantially downstream of front plate" means that most of the liner is arranged on the downstream side of the front panel while some elements may be arranged laterally or even on the upstream side of the liner (such as, for example, the flange 48 in FIG. 9). The term "substantially fluid-tight manner" means that a leakage rate is not larger, preferably smaller than leakage rates achieved by conventional fastening methods. The term "combustor part" refers to the front panel, the combustor liner, and the carrier structure element. The term "combustor elements" refers to burner units, mixers, pre-mixers, and/or igniters. The term "diameter" is to be understood as the maximal breadth of the respective part.

In the context of the present invention, the term "elongated intermediate section" refers to a rod-like portion of the elastic connection element, the elongated intermediate section connecting the end portions of the connection element to one another. The elongated intermediate section is preferably substantially straight. The connection element's material (in particular as regards its Young's modulus) and its shape (in particular its cross-sections area) are chosen such that it clamps, in the cold state, the front panel, the combustor liner, and the carrier structure element to one another in a fluid tight manner. Accordingly, in some embodiments of the combustor arrangement, each of the at least one elastic connection elements may comprise an elongated intermediate section, the elongated intermediate section extending substantially in axial direction and being designed for pre-clamping the front panel, the combustor liner, and the carrier structure element to one another in a cold state.

In some embodiments, the elastic connection element comprises a first end portion and a second end portion, wherein the elongated intermediate section connects the first and second end portion to one another, and wherein interlocking elements are provided at the first and second end portions for interlocking the elastic connection element to the front panel, the combustor liner, and/or the carrier structure element such as to clamp the combustor parts under tensile stress of the elongated intermediate section.

Upon heating the combustor arrangement, e.g. firing the gas turbine into which the combustor arrangement may be integrated, thermal expansion occurs with all the heat exposed parts. The choice of material of the fastening system is preferably such that said thermal expansion is not decreasing the clamping force that clamps the combustor arrangement together. Preferably, the clamping force is even enhanced by the thermal expansion (thermal matching).

In some embodiments, contact portions of the front panel, the combustor liner, and the carrier structure element are arranged on one another in axial direction. These contact portions contact one another at least pairwise and at least partially in the clamping region and built up a stack. At least the axially outer two of said stacked contact portions of the front panel, the combustor liner, and the carrier structure element each comprise a clamping flange. The clamping flanges of at least the axially outer two of the front panel, the combustor liner, and the carrier structure element have at least one, preferably at least two or more circumferentially arranged recesses for each receiving the first or the second end portion of one elastic connection element for the clamping action of the front panel, the combustor liner, and the carrier structure element in axial direction.

In some embodiments, said contact portion of the combustor liner is arranged between said contact portions of the carrier structure element and the front panel. Thereby, inwardly protruding flanges may be used, which is beneficial for cooling an outer surface of the combustor arrangement as there is less obstruction to the cooling flow.

In other embodiments, said contact portion of front panel is arranged between said contact portions the carrier structure element and the combustion liner. This is advantageous, as the front panel may have an outer side wall with a swan neck profile, the profile including a radially outwardly protruding clamping ring, which allows separating the upstream end of the combustion chamber from the clamping region (see below).

In some embodiments, the clamping structure may directly engage all three combustor parts, in other embodiments, the clamping structure is only fixed to the axially outer parts of the front panel, the combustor liner, and the carrier structure element and the part therebetween is clamped by said outer parts. A form-fit engagement, at least in lateral direction, of all three the front panel, the combustor liner, and the carrier structure element is, however, preferred. This may be achieved by guiding the elastic connection element through recesses in all these three parts.

The elastic connection element is designed and arranged on the combustor parts such that a thermal expansion in lateral direction is possible. It may be made from steel or any other high temperature material for an expected operating temperature in the range of 400° C. to 750° C. or even higher. Preferably it has an elasticity of 180-220 GPa at room temperature with a coefficient of thermal expansion between 10-19*10-6 1/K at operating temperature. The used material must be sufficiently creep resistant at operating temperature. Possible Materials may be: nickel or iron based alloys like Alloy X-750, Nimonic 80A, or 1.4911, 1.4939, 2.4975, etc.

Generally, a lateral thermal expansion is different in magnitude for the different combustor parts. Accordingly, a relative lateral movement may occur between the combustor parts. In order to compensate for this lateral shift, without losing the desired clamping force of the fastening system, the elastic connection element is arranged and designed such that it follows the deformation whilst not reducing, preferably even enhancing the clamping force between the combustor parts. This may be achieved by arranging the elastic connection element at a lateral distance, e.g. 5 to 100 millimeters, from the combustor part walls. The elastic connection element may then, due to its elasticity and thermal expansion, follow the relative lateral movement of the combustor parts such that the clamping effect remains and undesired leakage of fluids between the combustor parts is avoided even under lateral stress.

In some embodiments, the front panel has, at its peripheral edge a circumferential outer side wall that preferably protrudes into the downstream direction, i.e. the front panel is not flat. Thereby, the thermal stress on the clamping region, where all the combustor parts meet, may be reduced.

In some embodiments, the outer side wall has a swan neck profile, wherein a free end portion of the side wall is shaped as a laterally outwardly protruding clamping ring for engagement with the fastening system wherein, preferably, the clamping ring is clamped between the contact portions of the carrier structure element and the combustor liner.

In other embodiments, the front panel is a flat plate and provides the downstream contact portion of the stack portions in the clamping region. Accordingly, a liner flange may protrude inwardly, whereby obstruction structures on the outside of the casing parts are avoided.

In other embodiments, the outer side wall has a profile with an L-shape, wherein a free end portion of the side wall is shaped as a laterally inwardly protruding clamping ring for engagement with the fastening system. Accordingly, the fastening system may be arranged on the inside of the liner and carrier structure element. This embodiment combines the advantages of the aforementioned two embodiments.

In some embodiments, the fastening system is designed such as to allow for relative movement in lateral direction between the carrier structure element and the combustor liner and/or the front panel due to thermal expansion in that the elongated intermediate section has a shape and/or is made from a material such that it is deformable under said relative movement while keeping the clamping action for fluid tight connection between the front panel, the combustor liner, and the carrier structure element. Said relative movement is allowed by the fastening system as the fastening system has not only axial but also lateral flexibility. This flexibility may only stem from the elongated intermediate section. Preferably, however, also at least one of the flanges receiving the elongated intermediate section is shaped such as to allow a radial tilt of the elongated member. This may be done by providing recesses in preferably one or both flanges that have an enlarged lateral clearance.

In some embodiments, the elongated intermediate section has a length and a minimum cross-sectional diameter D, wherein the minimum cross-sectional diameter D has a length from 6 millimeters to 52 millimeters. In some embodiments, a ratio L/D ranges from 7 to 30. In some embodiments, the elongated intermediate section has a maximum cross-sectional diameter b, wherein a ratio D/b ranges from 1 to 22.

In some embodiments, the first and/or the second end portion has a larger cross-sectional area than the intermediate section. In some embodiments, the intermediate section has a constant cross section over its length L, said cross section being preferably at least part round or entirely round, in particular circular or elliptical, or being polygonal, in particular rectangular. In some embodiments, the elastic connection element is a single-piece element. In some embodiments, transitional elements connect the first and/or second end portions and the intermediate section to one another, wherein the transitional elements may preferably be shaped as cones, fillets, or a combination thereof.

In preferred embodiments, thermal matching is applied by choice of shape and/or material of the fastening system and of the front panel, the combustor liner, and the carrier structure element such that the thermal expansion in axial direction of first axial expansion sections B1, B2 of the fastening system is, in total, smaller than the thermal expansion in axial direction of second axial expansion sections Ca1, Ca2, Ca3 of the front panel, the combustor liner, and the carrier structure element.

The term "first axial expansion sections" refers to sections of the combustor arrangement which, upon thermal expansion, increase a clamping width of the fastening system. The clamping width is the distance between the clamping surfaces onto which the elastic connection element acts. The term "second axial expansion sections" refers to sections of the combustor arrangement which are compressed under the clamping action of the clamping system. This means that thermal expansion of the second axial expansion sections increases clamping force, while thermal expansion of the first axial expansion sections decreases clamping force (as the clamping width is increased).

In some embodiments, a compensation element with a predefined thermal expansion coefficient is included in the first axial expansion sections B1, B2 and/or in the second axial expansion sections Ca1, Ca2, Ca3 such that a clamping force of the fastening system is enhanced upon thermal expansion of the compensation element. The clamping force is enhanced if the following inequality is satisfied upon heating:

$$\Sigma B_{1\ldots2}<\Sigma Ca_{1\ldots3}$$

In some embodiments, the interlocking element is an element that sits on the upstream surface of the flange of the carrier element structure or on the downstream surface of the liner flange or the front panel and wherein the compensation element is arranged between said upstream surface of the flange or downstream surface of the liner flange and the respective flange, wherein, preferably, the interlocking element itself is configured as the compensation element.

It is also an aspect of the present invention to provide a gas turbine comprising a combustor arrangement as described herein.

A "silo combustor" is to be understood as a combustion chamber with mainly cylindrical shape connected to turbine via a transition duct. At least one, preferably up to 42 silo combustors are arranged around a rotor axis of the turbine with an angular orientation to the axis between 7° and 90°.

In some embodiments, the combustor arrangement comprises:

- A tubular combustor liner
- A support structure (the carrier structure element)
- Front panel (or end plate)—a dished plate with a clamping ring and a number of burner-rim pieces which act as counterpart for the burner exit tubes
- Number of elastic elements for axial clamping, like slim bolts or alternatives
- Preferably a Swan-neck profile for front panel side wall
- Additional methods of thermal expansion matching
- Sealed and flexible joint at burner exit tubes Combustor liner and front panel are clamped to a common carrier structure element by the flexible fastening system. Furthermore, preferably, the materials are combined such that the flexible elements are made of a material with relatively low coefficient of thermal expansion compared to the other elements so they are stretched in operation. Due to their elasticity (Young's modulus and cross-sectional area), the resulting force is high enough to keep parts in place, also under oscillating pressure loads (e.g. caused by pulsations) while at the same time allowing for relative movements between the combustor parts in lateral direction due to different thermal expansions.

BRIEF DESCRIPTION OF THE DRAWINGS

Preferred embodiments of the invention are described in the following with reference to the drawings, which are for the purpose of illustrating the present preferred embodiments of the invention do not limit the same. In the drawings, FIG. 1 shows a cross-section view of a part of a gas turbine with a combustor arrangement comprising a fastening system according to the present invention;

FIG. 2*a* shows a cross-section view a detail of FIG. 1 with the fastening system according to an embodiment with an additional compensation element;

FIG. 2*b* shows front view of part of the fastening system according to FIG. 2*a;*

FIG. 2*c* shows a front view of part of the fastening system according to a further embodiment;

DETAILED DESCRIPTION

Figure 4:
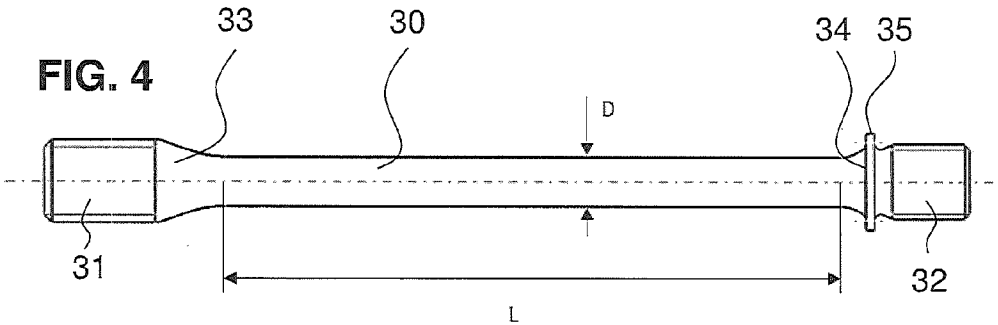
FIG. 4 shows an elastic connection element of the fastening system according to the previous figures.

Preferred embodiments of the present invention are now described with reference to FIGS. 1 to 10, showing various aspects of the combustor arrangement according to invention.

FIG. 1 shows different parts of a gas turbine 1. The gas turbine 1 comprises a combustor arrangement 10, a hull 6, burner units 9 with fuel supplies 90, further support structures 7, a transition duct 12, and a turbine 11.

The combustor arrangement 10 comprises a carrier structure element 2, a front panel 5, a combustor liner 4, and a fastening system 3. The carrier structure element 2 carries both the front panel 5 and the combustor liner 4. Accordingly, it provides, together with the further support structures 7, rigid structural support to parts fixed thereon or thereto. The carrier structure element 2, the front panel 5, and the combustor liner 4 are clamped to one another by means of the fastening system 3.

The front panel 5 is a generally plate-like end wall with receptions or rim elements (not shown), the latter acting as counterparts for receiving at least one, preferably a plurality of burner units 9, mixers, pre-mixers, and/or igniters or the like. The receptions include passages for conveying fluids, such as oxidizers and fuel, from an upstream side to a downstream side of the front panel 5. On its downstream side, the front panel 5 defines a flame or hot side and partly delimits a combustion zone 40. The upstream side of the front panel 5 is the cold side. In the embodiment according to FIG. 1, the burner units 9 are arranged on the cold side and are fixed to the front panel 5. Exit tubes of the burner units 9 may be sealed to the front panel 5 by sliding joints. The front panel 5 is generally shaped as a dished plate that includes, at its peripheral edge, a circumferential outer side wall 53, the latter being oriented substantially axially and being connected to the dished plate at a downstream edge and having a free end at its upstream edge (see FIG. 2). A radially protruding clamping ring 54 is provided at the free upstream edge of the dished plate (see below). Accordingly, the outer side wall 53 protrudes substantially axially from the dished plate in downstream direction into the cold side. The outer side wall 53 helps to shift the clamping region way from the hot zone to further reduce thermal stress. The clamping region is the region where contact portions of the carrier structure element 2, the front panel 5, the combustor liner 4 meet one another and are clamped by the fastening system 3 to one another.

The carrier structure element 2 may be connected to the further carrier structure 7 for support and comprises a generally axially oriented side wall 22 that circumferentially surrounds the burner units 9 and provides thereby a substantially cylindrical casing for the burner units 9 (see FIG. 2). The casing for the burner units 9 is covered, at the upstream side, by a cap-like hull 6. The fuel supply lines 90 for the burner units 9 are guided through the hull 6. Accordingly, the space for housing the burner units 9 is substantially delimited by the front panel 5 in downstream direction, by the side wall 22 of the carrier structure element 2 and the hull 6 in radial direction, and by the hull 6 in upstream direction.

The combustion liner 4 has preferably a tubular shape and is arranged downstream of the front panel 5. The liner 4 provides a substantially cylindrical and substantially axially extending side wall that delimits the combustion zone in radial direction. Accordingly, a combustion chamber 40 is defined by the front panel 5 and the liner 4.

An upstream end portion 42 of the combustion liner 4 circumferentially surrounds the outer side wall 53 of the front panel 5 and contacts, with a liner flange 44 at its upstream end portion 42, a downstream facing surface of the clamping ring 54 of the front panel 5. The carrier structure element 2 contacts, with a downstream end portion of its side wall 22, the upstream surface of the clamping ring 54. Accordingly, the clamping ring 54 is clamped, in the clamping region, between the side wall 22 and the flange 44, wherein the side wall 22 and the flange 44 are axially aligned (i.e. they contact the same radial portion of the clamping ring 54, the wall 22 from the upstream side, the flange 44 from the downstream side).

The fastening system 3 comprises a plurality of elastic, rod-like connecting elements 39 that are fixed to the carrier structure element 2 upstream of the clamping region and to the liner flange 44 and that extend generally in axial direction over the clamping region and connect the carrier structure element 2 to the liner 4. The connecting elements 39 are arranged around the ring-like flanges 21, 44.

A downstream section of the liner 4 is shaped as a tapering portion 41 which narrows a radial clearance of the combustion chamber 40 in downstream direction and guides the working fluid to the transition duct 12, the latter joining the downstream end of the liner 4 in an connecting region 13.

The transition duct 12 then further guides the compressed working fluid to a turbine 11, over which the working fluid is expanded under generation of genetic energy in the gas turbine 1.

FIG. 2*a* shows a cross-section view of a detail of the fastening system 3 with details of the carrier structure element 2, the front panel 5, and the combustor liner 4.

The carrier structure element 2 has its side wall 22 arranged in axial direction aligned with the upstream portion 42 of the liner 4. In the upstream region of the side wall 22 is provided a lateral portion 21 which protrudes outwardly from the side wall 22. The lateral protrusion 21 forms a flange with an upstream surface 25 and a downstream surface 26. The flange 21 includes a connecting portion 23 that connects the radially oriented flange 21 to the axially oriented side wall 22. The connection portion 23 has an increased material thickness toward the side wall 22 for providing sufficient mechanical stability to the carrier structure element 2. In the connection portion 23 is provided a substantially axially oriented recess 24 in the lateral portion 21. The recess 24 is provided as a through hole and connects the upstream surface 25 and the downstream surface 26 to one another. The recess 22 extends substantially parallel and at a radially distance of 1 centimeter to 10 centimeters to the side wall 22. The recess 24 is dimensioned such that one rod-like elastic connection element 39 can extend therethrough from the upstream surface side to a downstream surface of the flange 21.

The elastic connection element 39 is a flexible pre-load element that clamps, through its elasticity, the casing parts (carrier structure element 2, front panel 5, and combustor liner 4) to one another when in cold state (i.e. flame-off and after cool down). Preferably, the materials and shapes of the casing parts and the elastic connection elements 39 are chosen such that, in hot state (flame on), thermal expansion further increases the clamping force of the fastening system 3. This can be achieved, for example, by providing the casing materials from a material with a larger thermal expansion coefficient than the thermal expansion coefficient of the material of at least parts of the elastic connection element 39 or by providing additional elements (e.g. compensation element 300, see below) to decrease the clamping length (parts that experience tensile stress due to clamping) relative to the clamped length (parts that experience compressive stress due to clamping) upon thermal expansion.

The elastic connection element 39 is part of the fastening system 3 and comprises an elongated intermediate portion 30, a first end portion 31 (the upstream end portion) and a second end portion 32 (the downstream end portion). The elastic connection element 39 is provided as rod-like element with a length of the length L of the intermediate portion that ranges from 40 millimeters to 1700 millimeters. The elongated connection element 30 connects the upstream end portion 31 and the downstream end portion 32 of the elastic connection element 39 to one another.

The liner flange 44 at the upstream end portion 42 of the liner 4 is the counterpart of the flange 21 of the carrier structure element 2. Both flanges 21, 44 protrude radially outwardly. In other embodiments (see FIG. 9) both flanges may protrude radially inwardly.

Figure 3:
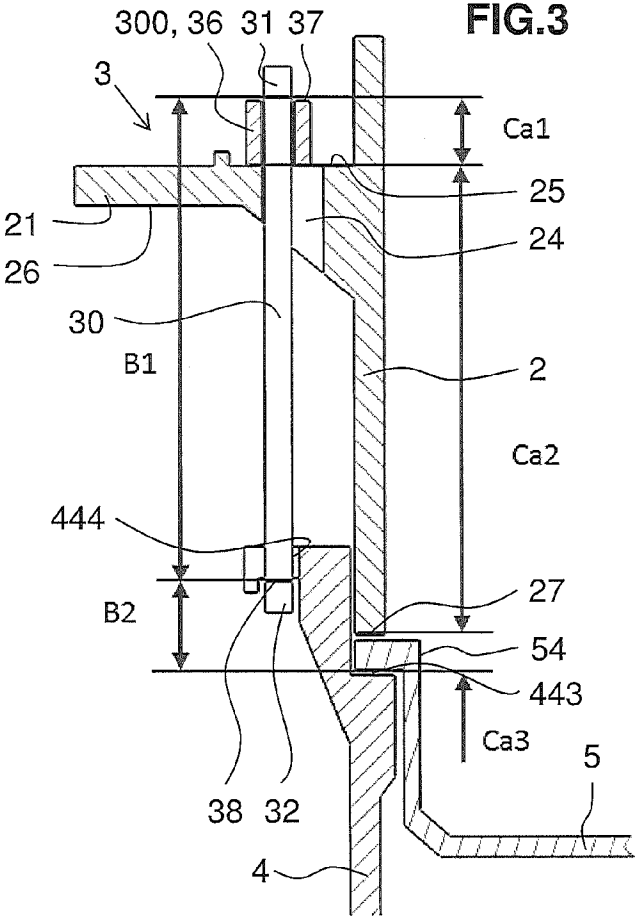
FIG. 3 shows in cross-section view the fastening system according to FIG. 2*a;*

The liner flange 44 according to FIGS. 1 to 3 comprises a radially outwardly protruding portion 441 and a laterally inwardly protruding portion 442. The portions 441, 442 provide each a laterally oriented upstream surface and a downstream surface. The radially inwardly protruding portion 442 provides a step 43 with a clamping surface 443 for receiving and clamping the clamping ring 54 of the front panel 5. The radially outwardly protruding portion 441 provides the recess 444 extending as a through hole from the upstream surface to the downstream surface of the portion 441. The recess 444 is axially aligned with the recess 24 of the flange 21 and has a radial width that matches a material thickness of the respective part of the elastic connection element 39.

Moreover, the outwardly protruding portion 441 of the liner flange 44 has, at its free end, hook elements 45 which protrude in downstream direction over the downstream surface of the flange 44 for engaging and securing the elastic connection element 39. The hook elements 45 avoid a lateral shift of the elastic connection element 39.

FIG. 2*b* presents a front view of the elastic connection element 39 and the flanges 21 and 44. As can be seen in FIG. 2*b*, the recess 24 extends, between the two hook elements 45, to the outside through a laterally extending slot 444 for insertion of the elastic connection element 39. In the embodiment according to FIG. 2*b*, the elastic connection element 39 has lateral engagement protrusion at its first and second end 31, 32 for engaging with the flanges 21, 44. Thereby, the elastic connection element 39 is kept in a form-fit seat in the liner flange 44 and in the flange 21 of the carrier structure element 2. The flange 21 has an upstream protruding rim 250 on its upstream surface next to the upstream end portion 31 of the elastic connection 39.

In other embodiments, the first and second end portions 31, 32 and the flanges 21, 44 may be provided with different engagement structures for providing a form-fit seat of the first and second end portions 31, 32 in the flanges 21 and 44, respectively. As a further example, the fastening structure for the first end portion 31 may include a compensation element 36, 300 that is counterpart to a threaded portion of the first end portion 31 while the second end portion 31 has a threaded section that is engaged into a threaded blind hole in flange 44 (see FIG. 2*c*).

The recess 24 in the flange 21 according to FIG. 2*a* is widened laterally toward the side wall 22 of the carrier structure element 2 as compared to the recess 444 in the liner flange 44. The radial width may be twice the radial material thickness of the relevant portion of the elastic connection element 39 in recess 24. Thereby, recess 24 provides space for tilting and deformation movements of the elastic connection element 39 during clamping. These movements may occur if there is a relative lateral movement between different clamped parts due to different thermal expansions of the same, which may entail a misalignment of the axial alignment of the recesses 24, 444 of the flanges 21, 44 respectively.

A possible shape of a deformed and tilted elastic connection element 390 is shown in FIG. 2*a* by the dashed line. The different thermal expansion, e.g. the stronger radial thermal expansion of the liner 4 and the contact panel 5 relative to flange 21 leads to a relative movement between the recesses 24 and 44. Accordingly, the recess 444 in the liner flange 44 shifts more in radially outwardly along arrow 391 than the recess 24 of the carrier structure element 2 shifts in radial direction. This may be caused by choice of material, geometry, or heat exposure. In order to compensate for this relative movement, the elastic connection element 39 is deformed, e.g. bent along its length L and tilted with its upstream end towards the side wall 22. Due to its elasticity and shape, the clamping force is maintained and not no additional leakages occur.

As can be seen in FIG. 2*a*, the front panel 5 comprises a flat plate 51, a bent transition section 52, the outer side wall 53, and the clamping ring 54. The outer region of the front panel 5 has a swan neck-like cross-section shape. The clamping ring 54 of the front panel 5 is placed with a downstream facing surface onto the clamping surface 443 of the liner 4 and contacts in lateral direction an axially oriented wall of the step 43 as shown in FIG. 2*a*. Moreover, a downstream front face 27 of the side wall 22 contacts the upstream surface of the clamping ring 54.

An axial height of the step 43 is chosen such that the clamping ring 54 and a downstream end portion of the side wall 22, including the front face 27, are circumferentially surrounded in radial direction by the liner flange 44 of the liner 43.

A radial depth of the step 43 and a radial thickness of clamping ring 54 are chosen such that the outer side wall 53 of the front panel 5 is close to the inwardly facing surface 46 of the radially inwardly protruding portion 442 of the flange 44 with a gap to allow for tolerances and misalignment. An axial downstream extension of the radially inwardly protruding portion 442 may be less than an axial extension of the outer side wall 53 such that the flat wall 51 is arranged downstream of the radially inwardly protruding portion 442, wherein a ring space 445 is created in the upstream portion of the combustion zone 40 (see FIG. 2*a*). This shape of the front panel 5 allows for keeping the hot side further away from the fastening system 3 and the clamping region.

Dimensions and materials of the different above described parts are chosen such that, in the cold state, the elastic connection element 39 clamps the downstream front face 27 onto the clamping ring 54 and the clamping ring 54 is clamped into the step 43 of the liner. The tensile modulus or the elasticity (Young's modulus) of the elastic connection element 39, in particular of its elastic intermediate section 30, and it cross-sectional area is to be chosen accordingly.

FIG. 3 shows a further aspect of a preferred embodiment of the present invention. Positive clamping force is achieved if, in hot condition, by fulfilling the following inequation:

$$\Sigma B_{1\ldots2} < \Sigma Ca_{1\ldots3}$$

wherein B1 and B2 designate lengths of expansion sections of the elastic connection element 39 and Ca1, Ca2, Ca3 designate lengths of expansion sections of the casing parts 2, 4, 5. An thermal expansion of Ca1, Ca2, Ca3 increases the clamping force, a thermal expansion of B1, B2 decreases the clamping force of the fastening structure 3.

Here, the expansion section Ca1 extends from an upstream surface 37 of the interlocking element 36, 300 to the flange 28 of the carrier structure element 2. The expansion section Ca2 extends from the upstream surface 25 of the flange 21 of the carrier structure element 2 to the downstream front face 27 of said element 2. The expansion section Ca3 extends from said downstream front face 27 to the clamping surface 443 of the liner flange 44. The expansion section B1 extends from the upstream surface 37 of the interlocking element 36, 300 to a downstream end 38 of the interlocking element 36, 300 (i.e. the latter's upstream surface contacting the flange 44). The expansion section B2 extends from said downstream end 38 of the interlocking element 36, 300 to the clamping surface 443 of the liner flange 44.

Accordingly, if the elastic connection element 39 expands, at least in axial direction, less than the casing parts, this further increases the clamping force of the fastening system 3 upon flame-on or heat exposure.

When selecting the materials for the different heat-exposed parts, not only their coefficient of thermal expansion, but also other properties like creep resistance, oxidation resistance, etc. should be considered as well. Accordingly, in some embodiments, the above inequation is satisfied by providing an additional compensation element 300 with a very high (or alternatively, a very low) thermal expansion coefficient in comparison to the other heat-exposed parts. According to FIG. 3, a high thermal expansion compensation element 300 may be arranged as a ring (or as the nut 36 itself) around the upstream end portion 31, between the upstream surface 25 of the flange 21 and the element 39. Upon thermal expansion of compensation element 300, the elongated intermediate section 30 is pulled partly through the recess 24 in upstream direction which shortens the required clamping length and increases clamping strength in warm operating conditions. The interlocking element 36 can for example be made of two clam shells for easier assembly.

FIG. 4 shows a preferred embodiment of the elastic connection element 39 which can also be seen in FIG. 2*c* (see above). The elastic connection element 39 is machined, milled and/or cast from as single-piece material. The elastic connection element 39 comprises the elongated intermediate section 30 that connects the first (or upstream) and the second (or downstream) end portions 31, 32 to one another. The intermediate section 30 (also called prism) has a round or polygonal cross-section that is constant over its length L. Moreover, the element 39 comprises interlocking or engagement features (such as the nut 36, 300) for engaging with the casing parts, and it includes and transitional sections 33, 34 which connect the intermediate section 30 to the first and second end portions 31, 32. The transitional sections 33, 34 match the different cross-sections of the intermediate section 30 and the first and second end portions 31, 32 to one another. Generally, the first and second end portions 31, 32 have an enlarged cross-sectional area with respect to the cross-sectional area of the intermediate section 30. The transitional sections 33, 34 may be cones, fillets and/or combinations thereof. The interlocking features 36, 300 may have any form of hooks or threads or the like.

At its second end portion 32, the elastic connection element 39 has a ring protrusion 35 that can be distanced a few millimeters from an upstream surface of the radially outwardly protruding element 441 of the flange 44 in assembled state or may be in contact with it. This represents a typical interface for assembly tools, like e.g. a hexagon to be used with wrenches. The ring can be used to apply a pre-tension to the elastic connection element 39.

Figure 5:
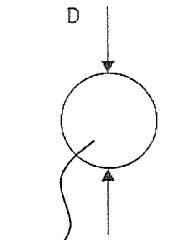
FIG. 5 shows a cross section through a first embodiment of the connecting element according to FIG. 4.
Figure 6:
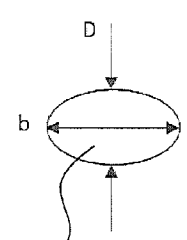
FIG. 6 shows a cross section through a second embodiment of the connecting element according to FIG. 4.
Figure 7:
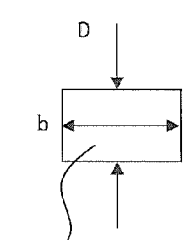
FIG. 7 shows a cross section through a third embodiment of the connecting element according to FIG. 4.
Figure 8:
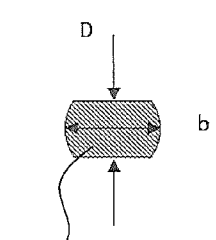
FIG. 8 shows a cross section through a forth embodiment of the connecting element according to FIG. 4.

FIGS. 5 to 8 show preferred embodiments of a cross section of the intermediate section 30. FIG. 5 shows an intermediate section 30 with a circular cross sectional profile having a diameter D. FIG. 6 shows an intermediate section 30 with an elliptical cross sectional profile with a transverse diameter b and a conjugate diameter D. FIG. 7 shows an intermediate section 30 having a rectangular cross sectional profile with a short long length b and a short side length D. FIG. 8 shows an intermediate section 30 with a circular cross sectional profile wherein the circle has a diameter b and wherein the top and bottom parts are cut such as to have flat, parallel opposing surfaces that are spaced apart by distance D.

As for the dimensions of the elastic connection element 39: The diameter D may range (for all the cross sections) from 6 millimeters to 52 millimeters. The ratio L/D may range from 5 to 50, preferably from 7 to 30. The ratio D/b may range from 1 to 22. Accordingly, the length L may range from 42 millimeters to 1560 millimeters and the width b may range from about 3 millimeters to 52 millimeters.

Figure 9:
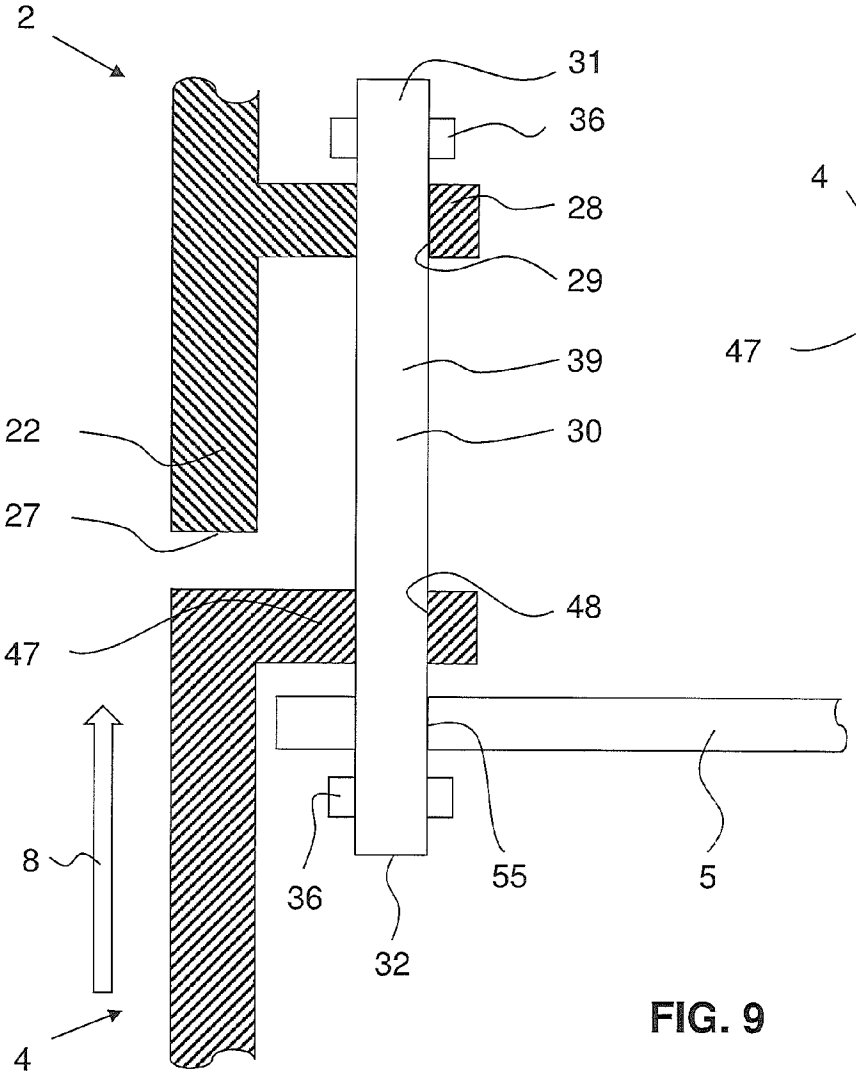
FIG. 9, 10 shows further embodiments of a combustor arrangement with a fastening system for combustor parts.

FIG. 9 shows a further embodiment of the combustor arrangement 10 comprising the carrier structure element 2 with the side wall 22, the fastening system 3 with the first and second ends 31, 32 and the intermediate section 30, the combustion liner 4, and the front panel 5. Flanges 28 and 47 correspond to flanges 21 and 44, respectively, of the carrier structure element 2 and the liner 4 in the above described embodiments. In the embodiment according to FIG. 9, the flanges 28 and 47 are, however, oriented inwardly and not outwardly as flanges 21, 44 in the above-described embodiments. In the embodiment according to FIG. 9, the front panel 5 is a flat plate that contacts the downstream surface of flange 47. Therefore, the front panel 5 and the carrier structure element 2 are clamped to one another, while the liner 4 is clamped between the front face 27 of element 2 and the upstream surface of the front panel 5. For assembly of this configuration a bayonet catch system can for example be applied on the end of the elastic connection elements 39 closer to the hot gas.

Accordingly, the front panel 5 may be a flat plate without an outer side wall 53 and may have through holes 55 extending from the hot side to the cold side and receiving the downstream portion of the elastic connection element 39. The flange 28 of the carrier structure element 2 has again through holes 29 for receiving the upstream portion of the elastic connection elements 39. At the first and second ends 31, 32 are provided nuts 36, 300 for fixing the elastic connection element 39 to the front panel 5 and the carrier structure element 2.

The advantage of the embodiment according to FIG. 9 is that no radially outwardly protruding elements (such as flanges 21, 44 in embodiments according to FIGS. 1 to 3) obstruct the flow 8 of a cooling fluid being convey over an outside surface of the liner 4 and carrier structure element 2.

The advantage of have a swan-neck like profiled front panel 5 that is clamped between the liner 4 and the carrier structure element 2 (as in the embodiment according to FIGS. 1 to 3) is that the clamping section is shifted away from the heat zone and can therefore be kept at lower temperature which reduces thermal stress and expansions. Also, it may be beneficial to minimize a gap between liner surface 46 and outer side wall 53 in order to keep hot fluids from the combustion chamber 40 away from the clamping region.

Figure 10:
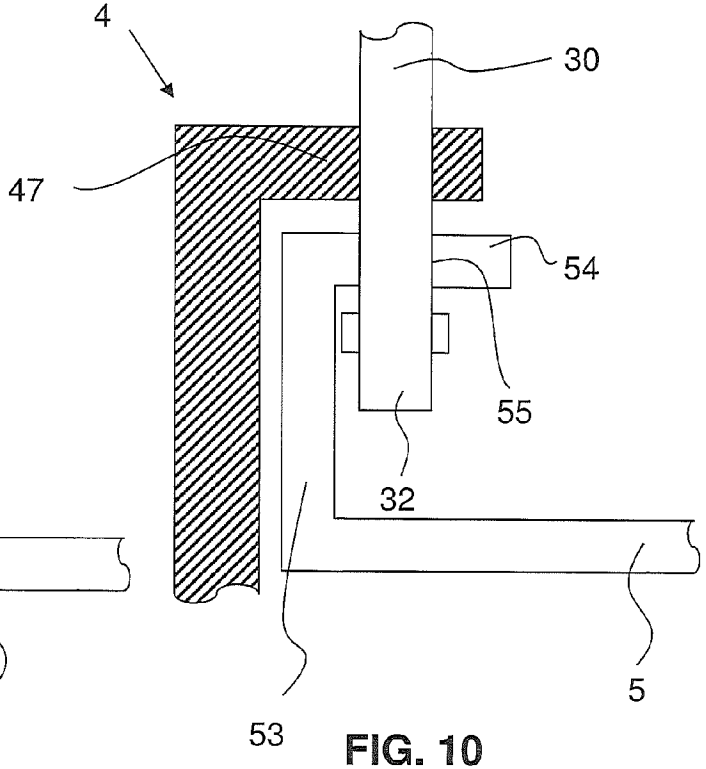

FIG. 10 shows a detail of yet another further embodiment which differs from the embodiment according to FIG. 9 only in the profile of the outer portion of the front panel 5. The embodiment according to FIG. 10 had an outer side wall 53 with an inwardly oriented clamping ring 54 and therefore combines the advantages of the embodiments according to FIGS. 2 and 9.

The herein described embodiments of the invention are given by way of example and explanation and do not limit the invention. To someone skilled in the art it will be apparent that modifications and variations may be made to these embodiments without departing from the scope of the present invention. In particular, features described in the context of one embodiment may be used on other embodiments. The present invention therefore covers embodiments with such modifications and variations as come within the scope of the claims and also the corresponding equivalents.

The invention claimed is:

1. A combustor arrangement, the combustor arrangement comprising:

an end plate configured to receive at least one combustor element;

a tubular combustor liner arranged substantially downstream of the end plate, wherein the tubular combustor liner partly delimits a combustion chamber;

a support structure having an axially oriented side wall that is configured to circumferentially surround the at least one combustor element and wherein the axially oriented side wall is arranged axially upstream of the end plate; and a fastening system for connecting the end plate, the tubular combustor liner, and the support structure to one another, the fastening system including at least one elastic connection element, the at least one elastic connection element being rod-shaped, the at least one elastic connection element being fixedly connected to the support structure and extending, substantially parallel with the axially oriented side wall, from the support structure to the tubular combustor liner and to the end plate, and wherein said at least one elastic connection element is fixedly connected to the tubular combustor liner and/or to the end plate to clamp the end plate, the tubular combustor liner, and the support structure to one another at a location which is axially upstream from the combustion chamber.

2. The combustor arrangement according to claim 1, wherein the at least one elastic connection element comprises:

an elongated intermediate section, the elongated intermediate section being configured for pre-clamping the end plate, the tubular combustor liner, and the support structure to one another in a cold state of the combustor arrangement.

3. The combustor arrangement according to claim 2, wherein the at least one elastic connection element comprises:

a first end portion and a second end portion, wherein the elongated intermediate section connects the first and second end portions to one another, and wherein respective interlocking elements are provided at the first and second end portions for interlocking and clamping the end plate, the tubular combustor liner, and the support structure to one another under tensile stress of the elongated intermediate section.

4. A combustor arrangement for a silo combustor, a can combustor, or an annular combustor, the combustor arrangement comprising:

a front panel, wherein the front panel is configured to receive at least one combustor element;

a combustor liner arranged substantially downstream of the front panel, wherein the combustor liner partly delimits a combustion chamber;

a carrier structure element for carrying the front panel and the combustor liner, the carrier structure element having an axially oriented side wall that is configured to circumferentially surround the at least one combustor element, and wherein the axially oriented side wall is arranged axially upstream of the front panel; and a fastening system for connecting the front panel, the combustor liner, and the carrier structure element to one another, wherein the fastening system includes:

at least one elastic connection element, said at least one elastic connection element being rod-shaped, said at least one elastic connection element being fixedly connected to the carrier structure element and extending, substantially parallel with said axially oriented side wall, from the carrier structure element to the combustor liner and to the front panel, wherein said at least one elastic connection element is fixedly connected to the combustor liner and/or to the front panel to clamp the front panel, the combustor liner, and the carrier structure element to one another at a location which is axially upstream from said combustion chamber.

5. The combustor arrangement according to claim 4, wherein the at least one elastic connection element comprises:

an elongated intermediate section, the elongated intermediate section being configured for pre-clamping the front panel, the combustor liner, and the carrier structure element to one another in a cold state of the combustor arrangement.

6. The combustor arrangement according to claim 5, wherein the at least one elastic connection element comprises:

a first end portion and a second end portion, wherein the elongated intermediate section connects the first and second end portions to one another, and wherein respective interlocking elements are provided at the first and second end portions for interlocking and clamping the front panel, the combustor liner, and the carrier structure element to one another under tensile stress of the elongated intermediate section.

7. The combustor arrangement according to claim 5, wherein a contact portion of the front panel, a contact portion of the combustor liner, and a contact portion of the carrier structure element are arranged on one another in an axial direction and wherein at least two of said contact portions each comprise:

a clamping flange, wherein the clamping flange has a recess, and wherein the recess is configured to receive a respective end portion of the at least one elastic connection element.

8. The combustor arrangement according to claim 7, wherein said contact portion of the combustor liner is arranged between said contact portion of the carrier structure element and said contact portion of the front panel.

9. The combustor arrangement according to claim 7, wherein said contact portion of the front panel is arranged between said contact portion of the carrier structure element and the contact portion of the combustor liner.

10. The combustor arrangement according to claim 4, wherein the front panel comprises:

at a peripheral edge of the front panel, a circumferential outer side wall that extends in an axially downstream direction.

11. The combustor arrangement according to claim 10, wherein the circumferential outer side wall of the front panel comprises:

a swan neck profile, and wherein a free end portion of the circumferential outer side wall is shaped as a laterally protruding clamping ring for engagement with the fastening system, wherein the laterally protruding clamping ring is clamped between a contact portion of the carrier structure element and a contact portion of the combustor liner.

12. The combustor arrangement according to claim 5, wherein the fastening system is configured to allow for relative movement, due to thermal expansion, in a lateral direction between the carrier structure element and the combustor liner and/or between the carrier structure element and the front panel, the elongated intermediate section having a shape and/or being made from a material such that the elongated intermediate section is deformable under said relative movement while providing a clamping force for the connection between the front panel, the combustor liner, and the carrier structure element.

13. The combustor arrangement according to claim 5, wherein the elongated intermediate section has a minimum cross-sectional diameter (D) and a length (L), wherein L ranges from 6 millimeters to 52 millimeters; and/or wherein a ratio L/D ranges from 7 to 30.

14. The combustor arrangement according to claim 6, wherein a cross-sectional area of the first end portion is larger than a cross-sectional area of the elongated intermediate section and/or a cross-sectional area of the second end portion is a larger than the cross-sectional area of the elongated intermediate section, and/or wherein the elongated intermediate section has a constant cross section over a length of said elongated intermediate section, said constant cross section being circular, elliptical, or polygonal, and/or wherein the at least one elastic connection element is a single-piece element, and/or wherein a first transitional element connects the first end portion and the elongated intermediate section to one another, the first transitional element being shaped as a cone or a fillet, and/or a second transitional element connects the second end portion and the elongated intermediate section to one another, the second transitional element being shaped as a cone or a fillet.

15. The combustor arrangement according to claim 4, a shape and/or a material of the fastening system and of the front panel, the combustor liner, and the carrier structure element being configured such that a thermal expansion, in an axial direction, of a clamping width of the fastening system is, in total, smaller than a combined thermal expansion, in the axial direction, of the front panel, the combustor liner, and the carrier structure element such that the front panel, the combustor liner, and the carrier structure element are thereby compressed under a clamping action in a hot state of the combustor arrangement.

16. The combustor arrangement according to claim 6, comprising:

a compensation element positioned at one of the first end portion of the at least one elastic connection element or the second end portion of the at least one elastic connection element, the compensation element being formed of a material having a thermal expansion coefficient such that a clamping force of the fastening system is increased upon thermal expansion of the compensation element in a hot state of the combustor arrangement.

17. A gas turbine comprising:

the combustor arrangement according to claim 4.

18. The combustor arrangement according to claim 6, wherein the first end portion and the second end portion are T-shaped.

19. The combustor arrangement according to claim 4, wherein the axially oriented side wall of the carrier structure element is aligned in an axial direction with an axially upstream portion of the combustor liner.

* * * * *